United States Patent [19]

Ford

[11] 3,941,080

[45] Mar. 2, 1976

[54] GAME POSITION MONITORING DEVICE

[76] Inventor: Patricia M. Ford, R.D. No. 1, Croghan, N.Y. 13327

[22] Filed: June 22, 1973

[21] Appl. No.: 372,604

[52] U.S. Cl. ..... 116/130
[51] Int. Cl. ..... G01d 13/04
[58] Field of Search ..... 116/130, 131, 133, 120; 235/78, 83, 88, 116, 122, 1; 273/85, 148

[56] References Cited

UNITED STATES PATENTS

| | | | |
|---|---|---|---|
| 1,502,619 | 7/1924 | Doob | 116/133 UX |
| 1,538,307 | 5/1925 | Strehlow | 273/85 |
| 2,008,153 | 7/1935 | Payne et al. | 273/148 |
| 2,164,466 | 7/1939 | Montgomery | 116/120 |
| 3,472,117 | 10/1969 | Iverson, Jr. et al. | 235/78 X |

*Primary Examiner*—S. Clement Swisher
*Assistant Examiner*—Denis E. Corr
*Attorney, Agent, or Firm*—Leon Nigohosian

[57] ABSTRACT

A device for monitoring the occupation of respective positions by team members in a game where each team member regularly changes position. It has a carrying element with a number of discrete spaces. At the spaces there can be individually provided information as to the position or team member. There is a movable element with the same number of spaces on the carrying element. The movable element carries the other of the two i.e. position or team member.

14 Claims, 11 Drawing Figures

GAME POSITION MONITORING DEVICE

BACKGROUND OF THE INVENTION

The present invention relates to a device for monitoring team game playing positions, particularly to such a device for monitoring such positions where various team members regularly change playing positions.

In a number of team games, including athletic games and otherwise, the respective members of the various teams regularly change positions at some predetermined or arbitrary point in the game, and it is important that the various team members play at a number of such positions in sequence or otherwise. It is, therefore, desirable to be able to keep track of, or monitor, the various players with respect to the different positions.

SUMMARY OF THE INVENTION

The present invention comprises a device for monitoring the team members in a game with respect to the various playing positions occupied by them, where the team members regularly change such positions. The device generally comprises a carrying, or support, element comprising a number of first spaces that preferably are delineated by dividing marks, and a movable element rotatably mounted on the carrying element, the movable element comprising a corresponding number of second spaces that also are preferably so delineated and the first and second spaces being respectively providable with one or the other of the playing positions and indicia identifying the various players of the team.

DESCRIPTION OF PREFERRED EMBODIMENT

Figure 1:
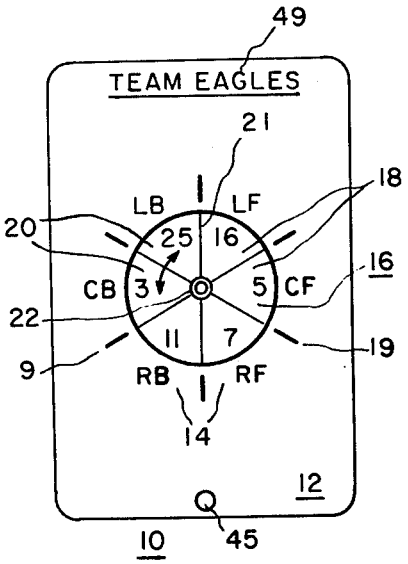
FIG. 1 is a top view of one embodiment of the present invention.

The position-monitoring device 10 of the present invention comprises a carrying member or element 12 that includes a number of spaces 14 adapted to receive the appropriate information, e.g., either the names of, uniform numbers of, or other indicia identifying the various playing members of the team or, as shown in FIG. 1, the positions (L.F., etc.) that are to be occupied in playing the game. The device 10 further comprises a rotatable element 16, shown as a wheel, that also has spaces 18 for receiving the appropriate information, e.g., the above-mentioned identifying indicia, shown as 20 in FIG. 1, or the playing positions. The rotatable element 16 is mounted on the carrying, or support, element 12 such that the various spaces 18 of the rotatable element 16 can be substantially aligned with the various ones of the spaces 14 of the carrying element 12. The spaces 14 and/or the spaces 18 can be delineated by markings 19, 21 respectively that are indelibly or eradicatably provided thereon. Also, the spaces 14 and/or the spaces 18 can be provided with the appropriate information in indelible or eradicatable form, the latter situation providing a monitoring device where the rotatable element spaces 18 and/or the carrying element spaces 14 are blank and information can be written therein.

Figure 2:
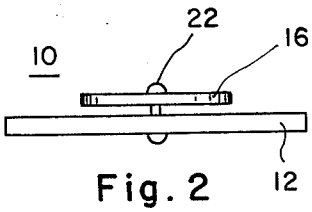
FIG. 2 is an end view of the device in FIG. 1.

The rotatable element 16 is mounted on the carrying element 12 by suitable means, such as a rivet 22, for example; an eyelet; etc. and both the carrying and rotatable elements can be flat and relatively thin, as shown in FIGS. 1 and 2, or can be partially or completely curved or non-planar as shown in FIGS. 4 through 11, i.e., concave or convex. The rotatable element and/or the carrying element of the present invention can be made made from, for example, a flexible or inflexible plastic material, cardboard or other suitable material.

In a second embodiment, the device 30 of the present invention comprises a carrying element 31 (FIG. 3) having plural discrete sets of individual spaces 36 and 38, respectively, and plural rotatable elements 40, 42 mounted on the carrying element 31. The rotatable elements 40, 42 also comprise respective spaces 44, 46 at which, as in the case of the spaces 36, 38, the appropriate information can be provided eradicatably or indelibly. The spaces 36 and 38, 44 and 46 of the rotatable elements 40, 42 can be delineated by marks, such as the lines 48, for example. In this embodiment, the sets of spaces on the carrying element 31 and their associated rotatable elements 40 and 42, respectively, can be used for different respective teams that are engaged in play.

The position-monitoring devices e.g., 10, 30 of the present invention can include apertures 45 that extend through the carrying elements 12 and 31, respectively, or hooks or other suitable elements, by means of which the devices can be held ready for use, as by being attached to the user's clothing or suspended, as by a cord, for example, from the user's body, e.g., from his arm or neck. The devices 10, 30 can also include, still further, spaces 49 (FIGS. 1 and 3) whereat there can be provided the name of the team or teams whose players' positions are being monitored.

Figure 4:
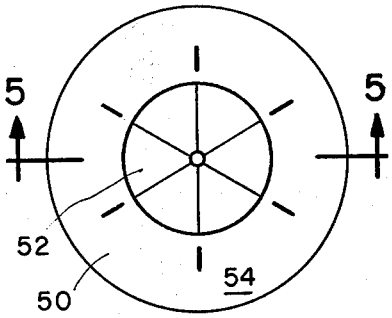
FIG. 4 is a top view of a further embodiment where the device has a curved configuration.
Figure 5:
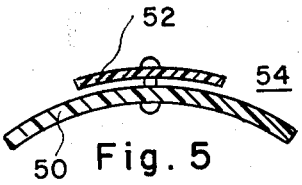
FIG. 5 is a sectional elevation view of the device of FIG. 4 along the axis 5—5.
Figure 3:
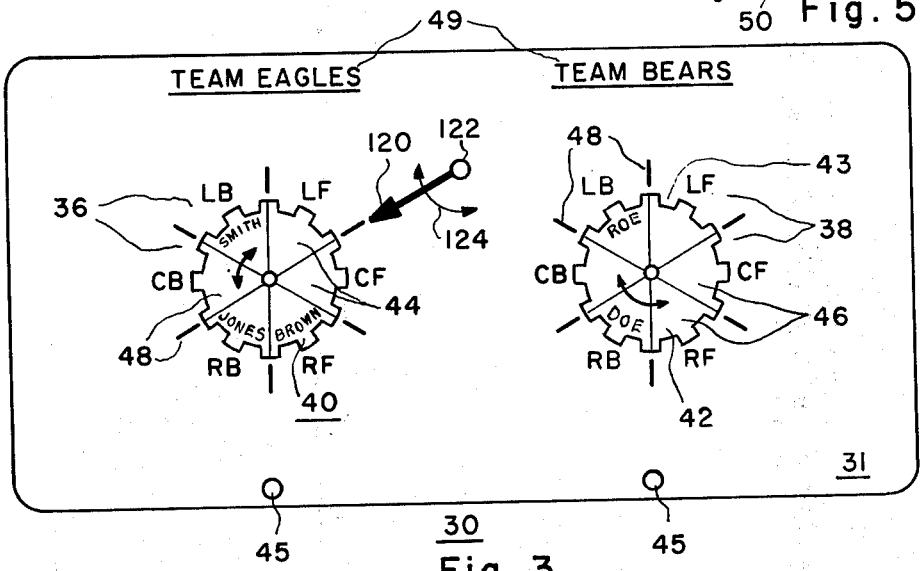
FIG. 3 is a top view of another embodiment of the present invention.
Figure 6:
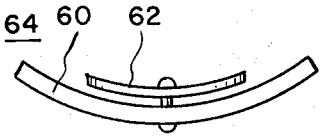
FIGS. 6 through 11 are sectional elevation views of various position-monitoring devices wherein one or both of the carrying, or support, elements and rotatable elements are nonplanar.
Figure 9:
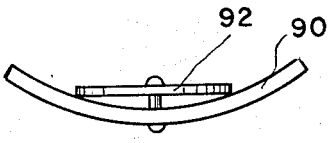
Figure 7:
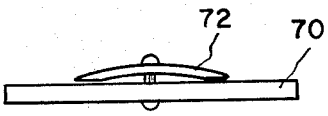
Figure 11:
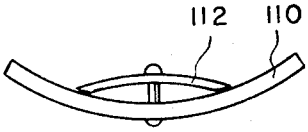
Figure 8:
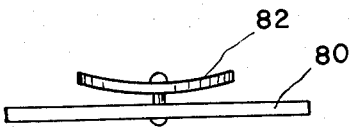
Figure 10:
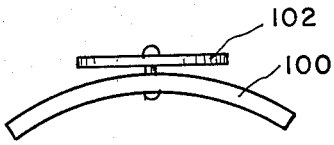

In still further embodiments, one or both of the respective carrying elements 50, 60, 70 etc., (FIGS. 4 through 11) and rotatable elements 52, 62, etc., of the position monitoring devices 54, 64, etc., can be nonplanar, or curved, e.g., convex of concave. In FIGS. 4 and 5, both the carrying element 50 and rotatable element 52 of the device 54 are convex, while the device 64 (FIG. 6) has a concave carrying and rotatable elements (60, 62). A planar carrying element (70, 80 in FIGS. 7 and 8) can be used with a convex or concave rotatable element (72 and 82), whereas a planar rotatable element (92, 102 in FIGS. 9, 10) can be used with a non-planar carrying element (90, 100). Where it is desired the carrying element (110 in FIG. 11) and rotatable element (112) can be non-planar in opposite orientation (i.e., concave and convex).

Where it is desired, the edge of the rotatable element can be serrated to ease its rotation, such a serrated edge 43 being shown for the rotatable element (or wheel) 42 in FIG. 3.

To illustrate using the present invention to monitor positions in, for example, a volleyball game, a monitoring-device, e.g., 10 in FIG. 1 and 30 in FIG. 3 is provided with information identifying the various positions among which the players are to move, such player movement being well known in volleyball. In this case, the positions, indicated by the abbreviations LB (left back), LF (left front), etc., have been provided at the spaces 14 of the carrying element 12 (although the invention can be practiced with the information provided at the respective spaces 18 of the rotatable element 16). The information 20 identifying the various players (i.e., their uniform numbers as in FIG. 1 or their names as in FIG. 3) is, in this case, provided at the spaces 18 of the rotatable element 16. As can be seen from FIG. 1, player 16 is at left front, player 5 is at center front, and so forth. When it is time for the players to change positions, (i.e., rotate according to volleyball rules), player 16 will move to CF, player 5 to RF, and so forth, so that the rotatable element 16 should be rotated (clockwise) by 60° such that the space bearing the player numeral 16 is opposite the space with CF. This carried out throughout the game as the players change positions.

In this way, the user, e.g., the umpire or other officiating person, can check the players' line-ups either after the player movement but before resumption of play or during play or both. As player substitutions are made, the identifying indicia of the player substituted for can be crossed out (or erased, if desired) and the indicia of the substituting player added (e.g. by pencil, chalk, etc.) at the same space, thereby providing an accurate check and record of substitutions and preventing improper substitutions.

Where it is desired, the monitoring-device of the present invention (e.g., 10 or 30 in FIGS. 1 and 3) can comprise an element for indicating, in a volleyball game, certain information about a team, e.g., whether the team last served or is next to serve the ball, etc. Such an indicating element is illustrated in FIG. 3 as pointer 120 that pivots about a pin 122 (as shown by arrows 124) to indicate which one of the teams has, for example, last served or is next to serve, although the indicating device can be used to making known other information relative to the teams that are playing.

I claim:

1. A device for monitoring the occupation of respective positions by the players of a team participating in a game wherein the individual team members regularly change such positions, said device comprising:

a. a carrying element comprising a number of first discrete spaces individually at which there can be provided information comprising one of respective ones of said positions and respective indicia identifying various ones of said team members and b. a movable element rotatably mounted on said carrying element, said movable element comprising an identical said number of second spaces individually disposable opposite respective ones of said first spaces, said second spaces being respectively providable with information comprising the other one of said respective ones of said positions and said identifying indicia.

2. A device as recited in claim 1, wherein at least one of said first and second spaces is adapted such that said information can be eradicatably provided thereat.

3. A device as recited in claim 1, wherein respective said positions are indelibly provided at one of said first and second spaces.

4. A device as related in claim 3 wherein respective said positions are provided at said first spaces.

5. A device as recited in claim 1, wherein said carrying element comprises a plurality of discrete sets individually comprising said number of delineated first spaces and said device further comprises a plurality of said movable elements cooperatively mounted with respective ones of said sets of first spaces.

6. A device as recited in claim 5, further comprising a pointer element pivotably mounted on said carrying element and being movable from a first position at which it points to a first said movable element to a second position at which it points to a second said movable element.

7. A device as recited in claim 1, further comprising means for suspending said device from a body part of the user thereof.

8. A device as recited in claim 1, wherein said carrying element and said movable element are substantially flat.

9. A device as recited in claim 1, wherein both said carrying element and said movable element have a configuration that is one of convex and concave.

10. A device as recited in claim 1, comprising a third space removed from said first and second spaces and adapted to be provided with team identifying indicia.

11. A device as recited in claim 1, wherein said movable element comprises a serrated edge, thereby facilitating rotation thereof.

12. A device as recited in claim 1, wherein only one of said movable element and said carrying element is substantially planar and the other one there is non-planar.

13. A device as recited in claim 1, wherein said non-planar element is one of concave and convex.

14. A device as recited in claim 1, wherein said carrying element is one of concave and convex and said movable element is the other of concave and convex.

* * * * *